US006533457B1

(12) United States Patent
Schwenke et al.

(10) Patent No.: US 6,533,457 B1
(45) Date of Patent: Mar. 18, 2003

(54) SACK

(75) Inventors: Dieter Schwenke, Schenefeld (DE); Robert Oster, Bornheim (DE)

(73) Assignee: Chronos Holdings Limited, Bestwood (GB)

( * ) Notice: Subject to any disclaimer, the term of this patent is extended or adjusted under 35 U.S.C. 154(b) by 0 days.

(21) Appl. No.: 09/391,949

(22) Filed: Sep. 8, 1999

(30) Foreign Application Priority Data

Sep. 8, 1998 (DE) ..... 198 40 792

(51) Int. Cl.[7] ..... B65D 30/12
(52) U.S. Cl. ..... 383/125
(58) Field of Search ..... 383/125, 126, 383/98, 120, 33; 493/218

(56) References Cited

U.S. PATENT DOCUMENTS

| | | | | | |
|---|---|---|---|---|---|
| 2,046,077 | A | * | 6/1936 | Johnson | 383/125 |
| 2,353,311 | A | * | 7/1944 | Karlson | 383/126 X |
| 2,353,402 | A | * | 7/1944 | Haslacher | 383/126 X |
| 2,689,438 | A | * | 9/1954 | Kindseth | 383/125 X |
| 2,799,443 | A | * | 7/1957 | Luhrmann et al. | 383/125 X |
| 2,845,849 | A | * | 8/1958 | Hahn | 383/126 X |
| 2,968,432 | A | * | 1/1961 | Craighead | 383/126 X |
| 3,117,711 | A | * | 1/1964 | Camerini | 383/126 |
| 3,237,534 | A | * | 3/1966 | Lissner | 383/125 X |
| 3,237,845 | A | * | 3/1966 | Piazze | 383/125 |
| 3,248,042 | A | * | 4/1966 | Kasting et al. | 383/126 |
| 3,397,622 | A | * | 8/1968 | Goodwin | 383/125 X |
| 3,688,650 | A | * | 9/1972 | De Vries | 383/126 X |
| 4,382,538 | A | * | 5/1983 | Wilharm | 383/126 |
| 5,913,764 | A | * | 6/1999 | Kolbe et al. | 493/218 |
| 6,042,526 | A | * | 3/2000 | Baumer | 493/218 |

FOREIGN PATENT DOCUMENTS

| | | | | |
|---|---|---|---|---|
| DE | 956192 | * | 1/1957 | 383/125 |
| EP | 0 525 337 | * | 2/1993 | 383/125 |
| FR | 1.089.416 | * | 3/1955 | 383/125 |
| GB | 723888 | * | 2/1955 | 383/125 |

* cited by examiner

*Primary Examiner*—Jes F. Pascua
(74) *Attorney, Agent, or Firm*—Howard M. Ellis

(57) ABSTRACT

The invention relates to a bag with a bag body consisting of four bag walls, onto which two first wide bag walls lie on top of one another and two second narrower bag walls are each folded over congruently onto themselves to the centre in a line along their longitudinal edges, and in which one end of the bag body is sealed by a bag floor and which forms a bag opening at the other end of the bag body; as well as an unsealed bag seal on a bag opening adjoining the bag body; in which the bag seal consists of two first sealing flaps respectively laid out on top of and adjoining the first bag walls, and two second sealing flaps adjoining the second bag walls, folded over respectively onto themselves at the centre in a line with the fold of the second bag walls; and in which at the respective ends of the first sealing flaps first gussets, and at the ends of the second sealing flaps second gussets are specified, and directly adjacent first and second gussets lie respectively on top of one another with their inner surfaces and are glued or heat-sealed together to form double layered sealing corners.

13 Claims, 6 Drawing Sheets

SACK

FIELD OF THE INVENTION

The invention relates to a bag which is manufactured from a rectangular pre-cut sheet of paper or foil, as well as a method for manufacturing, filling and sealing same. The bag is envisaged particularly for filling using powder-type filling materials. The packaging of powder-type filling materials into bags and the subsequent sealing of the bag seals creates a number of problems, which will be discussed in the following. In this connection, particularly for sealing paper bags, generally heat-sealing adhesive is applied to the sealing surfaces and these are heat-sealed together, or in the case of bags made of thermoplastic foil, the sealing surfaces are laid one on top of the other and thermally heat-sealed.

BACKGROUND OF THE INVENTION

One problem which can arise is that it is very difficult to suppress dust build-up during filling, which leads to soiling of the system and impacts on the workplace; it can even lead to the risk of dust explosions. Such dust build-up therefore needs to kept as minimal as possible.

In order to keep dust build-up during the filling process within manageable limits, ventilated bags are widely used in which a valve outlet is glued into a floor section at one end. The disadvantage of such bags is the reduced filling speed caused by the ventilated cross section, which is restricted by the introduction of a filling nozzle a few centimetres in diameter. Finally, manufacture and recycling is made expensive using the additional valve outlets.

As long as open bags are used, the filling speed can be increased, however the whole sealing surface gets covered with dust during the filling process, so that the sealing process is not always performed perfectly. A surface covered with dust not only impedes gluing with heat-sealing adhesives, but also using heat-sealing thermoplastic foil surfaces.

An additional problem is the fact that bags filled with powder-type filling materials, which after filling are, for example, sealed using an interlocking or floor section fold, whose folding corners have micro openings which are connected via ducts to the inside of the bag, from which filling product can escape and, particularly with foodstuffs, through which harmful pests can find their way in.

SUMMARY OF THE INVENTION

From this initial position therefore, the exercise of the invention at hand is to provide a new type of bag as well as a method for its manufacture, filling and sealing, one which allows for filling with the utmost suppression of dust build-up, on the other hand which has a larger filling opening than ventilated bags for an increased rate of fill, and finally which facilitates sealing of the seal unimpeded by dust build-up.

The solution therefore lies in a bag according to the invention, which is defined in the independent patent claims as a semi-finished product (empty bag, filled and unsealed bag) as well as a finished product (filled and sealed bag); as well as a method for their manufacture and for their filling and sealing, which are shown in the independent claims relating to the method. Reference is made in the following to the wording on the content of the claims in respect of the semi-finished product, the product itself and the method.

An empty, flat bag set for transportation prior to the opening and filling processes according to the invention is distinguished in that the seal is formed by first and second sealing flaps, onto which pairs of gussets located at the ends—formed by one of the sealing collars lying on a plane created by the four sealing flaps—is connected to sealing corners. In this connection, during manufacture the first sealing flaps in relation to the bag walls, onto which they adjoin are folded outwards away from the bag opening, whilst second sealing flaps, in relation to the bag walls, onto which they adjoin and which generally form the shorter bag walls, are folded inwards onto the bag opening. The connection in accordance with the invention, ie gluing or heat-sealing together of the gussets on the ends of the sealing flaps already commences prior to filling the bag, so that hermetically perfect 'sealing' of the corner areas of the bag seal is guaranteed.

The way of folding over the first sealing flaps and the second sealing flaps in relation to the bag opening, in accordance with the invention, results in the relief opening cross section of the bag for filling not being reduced, as opposed to a standard open bag, since with this a considerable portion of the bag triangle has to be available outside the filling nozzle for holding and handling, so that the absolute relief opening cross section lies considerably under the theoretical one; in comparison with a ventilated bag however, a considerably larger filling cross section is available. The frame-like sealing collar created by the above mentioned sealing flaps lying on a plane with the option of introducing a filling nozzle onto it to create a circumferential sealing facility, in which an area outside the effective sealing line can be kept free of dust, so that perfect 'sealing' is possible in this area after the filling procedure is complete.

The sealing corners can be created, according to one preferred configuration, by a type of folded corner, for example such as one formed as previously described, when first the sealing flaps are folded away outwards at right angles from the first bag walls, and second sealing flaps of the second bag walls are folded inwards at right angles, ie coming to rest on the bag opening. In this connection, gussets separated by a folding edge on the ends of the first and second sealing flaps are made congruent, and in a position with the original surfaces on the same side of the initial material. The contacting gusset areas form the basis for the 'sealing' process of the sealing corners, in which these are carried out by gluing or by heat-sealing.

According to a second embodiment of the sealing corners, each of the first and second sealing flaps can be designed with transverse edges, ie independent of the respective adjacent sealing flaps. This creates the option of using sealing flaps of various widths. For example, the first sealing flaps can be designed considerably wider in order to make room for a finger hole. Sealing flaps of this kind can be manufactured using corner incisions on the initial material, which are basically in the corresponding positions of the previously mentioned folding edges. In this connection the gussets demarcated by the corner incisions at the ends of the first and second sealing flaps are made congruent and come into position with the original surfaces on the same side of the initial material. The contacting gusset areas form the basis for the 'sealing' process of the sealing corners, in which these are carried out by gluing or by heat-sealing.

In this connection the bag body can be shaped as a side folding bag, in which the second bag walls and the second sealing flaps are folded inwards between the perimeter areas of the first bag walls. The bag can however also be folded as a simple flat bag, so that the second bag wall and second sealing flaps are folded outwards beyond the perimeter areas of the first bag walls. In any event the flared open bag body, prior to and after filling, essentially has a rectangular cross floor section, which is determined by the position of the sealing corners and thereby the defined length of the first and second sealing flaps.

The bag floor can be of any chosen configuration, for example a standard folded floor. Simple linear gluing or heat-sealing like a seamed seal are however also possible.

On a flat bag where the second walls are folded outwards, in addition to the sealing flaps, adjoining areas of the bag wall can each be turned outwards or inwards, so that on each of the ends of the linear bag opening two larger triangular overlapping areas form the first sealing flap and the second sealing flaps, from which however the sealing corners can only be formed by sealed partial surfaces opposing each other at a distance. The surfaces lying in between, but not connected to one another, become rectangular cross section shapes as parts of the respective bag walls, upon flaring open the bag. On the empty, compressed bags set for transportation, the sealing flaps can be folded over, connected together by the sealing gussets and/or by the first bag walls formed by the sealing corners of these laid out in the same manner on top of one another on the plane, so that a flat stackable product is generated.

In the filling process a single bag is extracted from the stack of bags with a suitable device and brought into a vertically suspended position. In so doing the sealing collar is again folded out and brought into a configuration standing away at rightangles from the bag body. Furthermore, both the first sealing flaps act as to clamps to hold down the bag on the sealing collar. A bag held in this way can be conveyed in its suspended position, filled and, if appropriate, weighed. Upon filling the bag, this directly causes the bag to flare open.

After the filling process a cover sheet can be laid over the bag opening, which can be circumferentially sealed onto the sealing collar. In this connection, this kind of cover sheet can be laid out flat on the frame-like collar surface, or glued or heat-sealed by its longitudinal edges to the first sealing flap surface and glued or heat sealed by its transverse edges against folded sealing strips on the relief edges of the second sealing flaps. The transverse edges of the cover sheet can in this connection be likewise folded out as sealing edges. A bag in this state is completely hermetically sealed in its sealing area, so that the subsequent connection of the first sealing flaps, which by turning over onto one another as a kind of seamed seal, or by laying on top of one another with the insides to form a bag- or finger-seal, only aid to stiffen and reinforce, whilst a dust free 'sealing' process is ensured by manufacturing sealing corners prior to the and after the filling process by laying out the cover sheet.

In the process of manufacturing a bag according to the invention, two fundamental methods of processing are possible, dependent upon whether gluing with a heat-sealing adhesive or other adhesive, or a thermal heat-sealing of the bag material itself is envisaged.

When using an adhesive, an adhesive deposit is placed on a perimeter strip on one transverse edge of an essentially rectangular pre-cut sheet, which forms the sealing strips when subsequently folded over onto the double ended open bag body. Along one of the first longitudinal edges running the length of the floor area, adhesive deposits are attached depending on the desired kind of bag floor. In one sealing area running along the opposing longitudinal edge, adhesive deposits are applied to four gusset areas, which each form the demarcation between the first and the second sealing flaps of the finished folded bag and subsequently form the sealing corners. A joint line, which separates the subsequent bag body from the subsequent bag seal, demarcates the adhesive deposits in so doing. The gusset shaped adhesive deposits can be applied to the first sealing flaps or to the second sealing flaps. Normally the sealing area is of a consistent width, in which the sealing corners are generated by the much described turning over of the first sealing flaps onto the second sealing flaps along a joint line. As long as the first sealing flaps and the second sealing flaps are of different widths, or as long as a fold between the sealing flaps can be avoided, the longitudinal edge is designed with incisions, which run along one of the edges of the gusset-shaped adhesive deposits. The sealing flaps separated from one another by the incisions are made congruent by simply laying one on top of the other in otherwise the same manner.

As long as the bag is made of a material to be thermally heat-sealed, the steps for the double folding of a rectangular pre-cut sheet for manufacturing a bag body open at both ends, as well as for the creation of a bag floor, and the steps for connecting on top of one another, the first sealing flaps and the second sealing flaps are the same steps as previously mentioned, ie the systematic folding processes are the same, however if thermal heat-sealing is to be used for manufacturing the sealing strips after double folding the pre-cut sheet parallel to the transverse edges, and heat-sealing of the sealing corners after the laying on top of one another of the gussets on the ends of the first and second sealing flaps must be undertaken. In both cases these heat-sealing processes are likewise performed prior to the filling process on the dust-free bag, and are thereby of unimpaired quality.

BRIEF DESCRIPTION OF THE DRAWINGS

Further details as to the shape of the semi-finished products and the finished products as well as on the method for manufacturing, filling and sealing the products are described in the following on account of the drawings.

a) as rectangular pre-cut sheet;

a1) A detail of the adhesive deposit in a first embodiment;

a2) A detail of the adhesive deposit in a second embodiment;

b) As rectangular pre-cut sheet with marked joint lines;

c) The conversion of the bag body;

d) As a flat bag body;

e) With pre-formed sealing area f) With pre-formed sealing collar;

g) With pre-formed sealing flaps;

h) With sealing flaps folded one on top of the other.

Figures 2A, 2B, 2C, 2D, 2E, 2F, 2G, 2H:
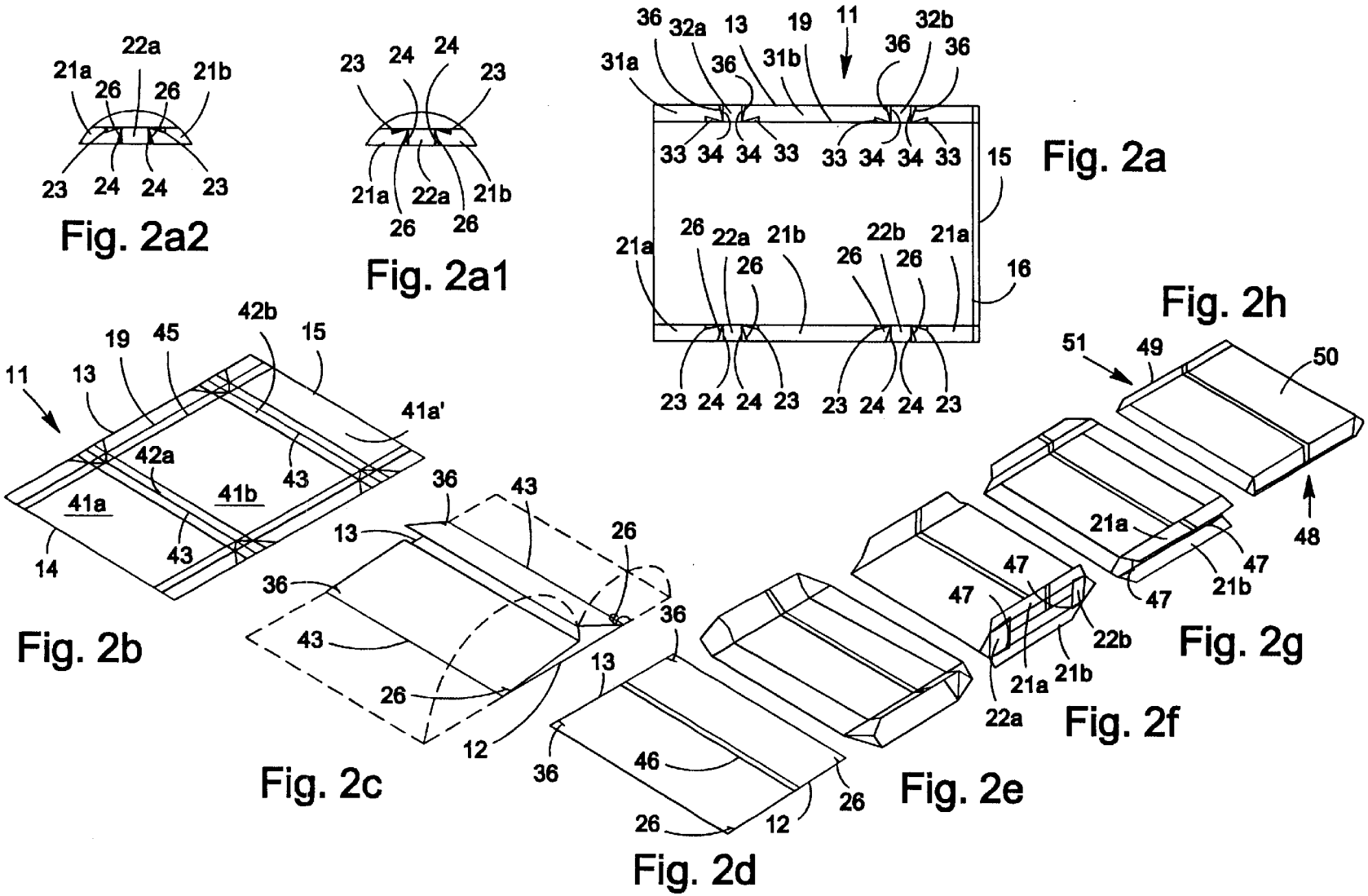

FIG. 2 Shows a first embodiment of a bag according to the invention in various manufacturing phases:

a) as rectangular pre-cut sheet;

a1) A detail of the adhesive deposit in a first embodiment;

a2) A detail of the adhesive deposit in a second embodiment;

b) As rectangular pre-cut sheet with marked joint lines;

c) The conversion of the bag body;

d) As a flat bag body;

e) With pre-formed sealing area;

f) With pre-formed sealing collar;

g) With pre-formed sealing flaps;

h) With sealing flaps folded one on top of the other.

Figures 3A, 3B, 3C:
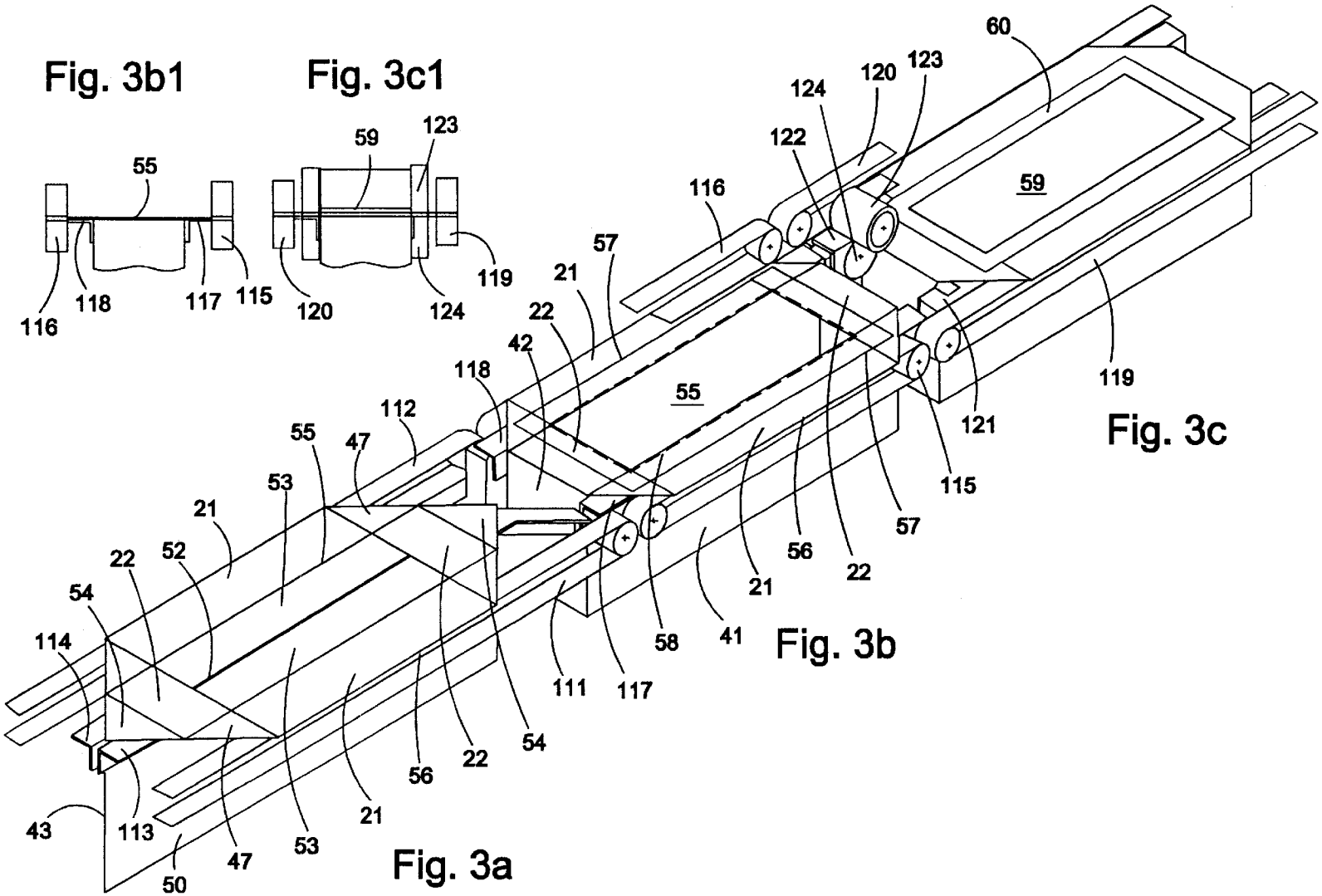

FIG. 3 Shows a bag according to the invention in three positions during the filling and sealing processes:

a) With linear shaped bag opening;

b) With rectangular flared open bag opening;

b1) In this connection the bag opening in cross section;

c) With cover sheet laid out;

c1) In this connection the bag opening in cross section.

Figures 4A, 4B, 4C, 4D, 4E, 4F, 4G, 4H, 4I, 4J, 4K:
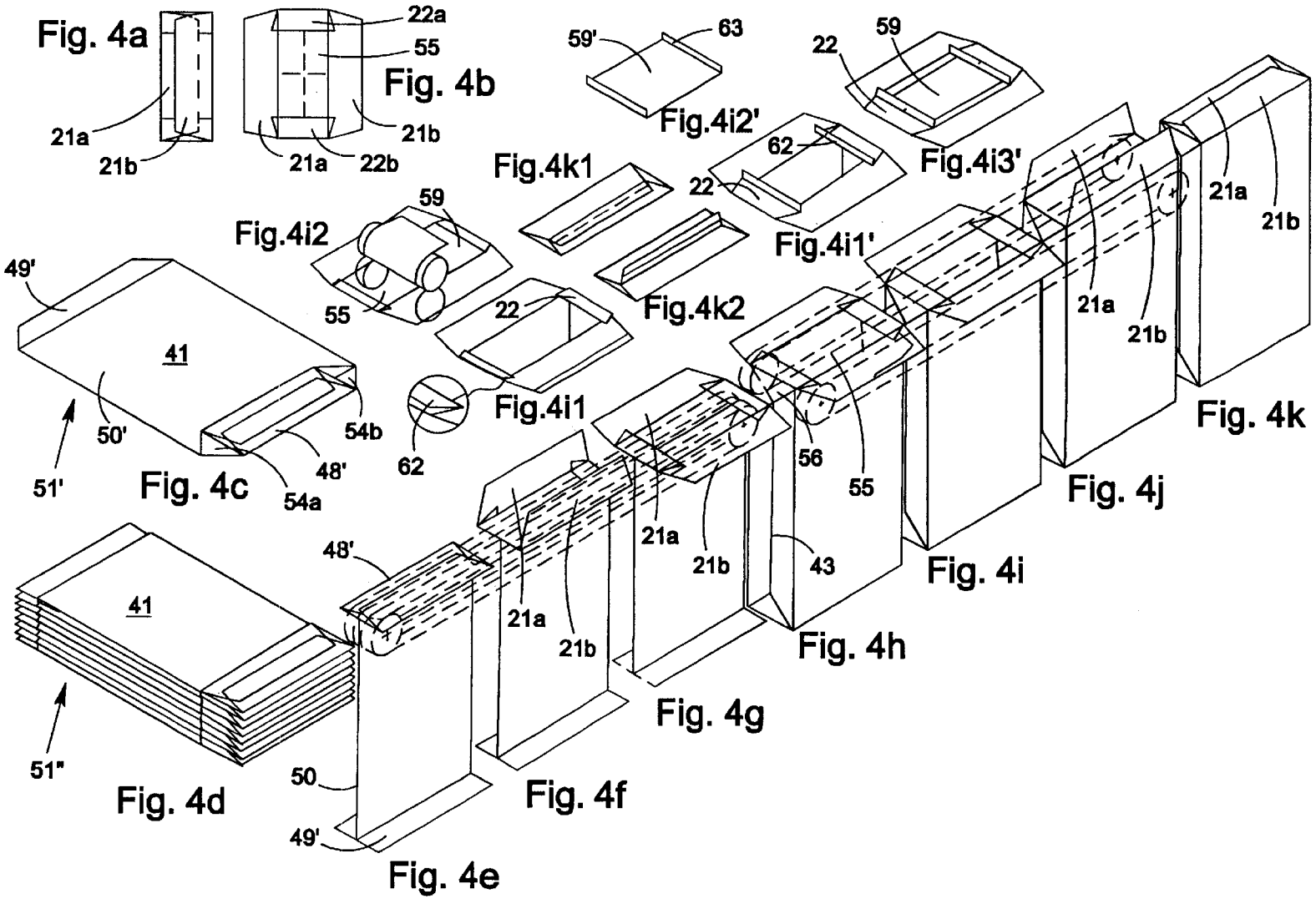

FIG. 4 Shows a bag according to embodiments in FIG. 2 in different phases of introduction, opening, filling and sealing.

a) A top view of the sealed bag seal;

b) A top view of the opened bag seal;

c) As transportable flat bag as a first embodiment, with the second bag wall folded outwards;

d) A stack of transportable bags as a second embodiment, with the second bag wall folded inwards;

e) With pre-formed bag opening in unfilled state;

f) With folded out first sealing flaps in unfilled state;

g) With turned out sealing collar in unfilled state;

h) With turned out sealing collar in flared open possibly filled state;

i) With turned out sealing collar in filled state;

i1) With unturned second sealing flaps;

i2) With rolled out flat cover sheet;

i1') With pre-formed second sealing flaps;

i2') A pre-folded cover sheet in detail;

i3') After the cover sheet has been laid out and glued;

j) In partially sealed state;

k) In sealed state.

Figures 5A, 5B, 5C, 5D:
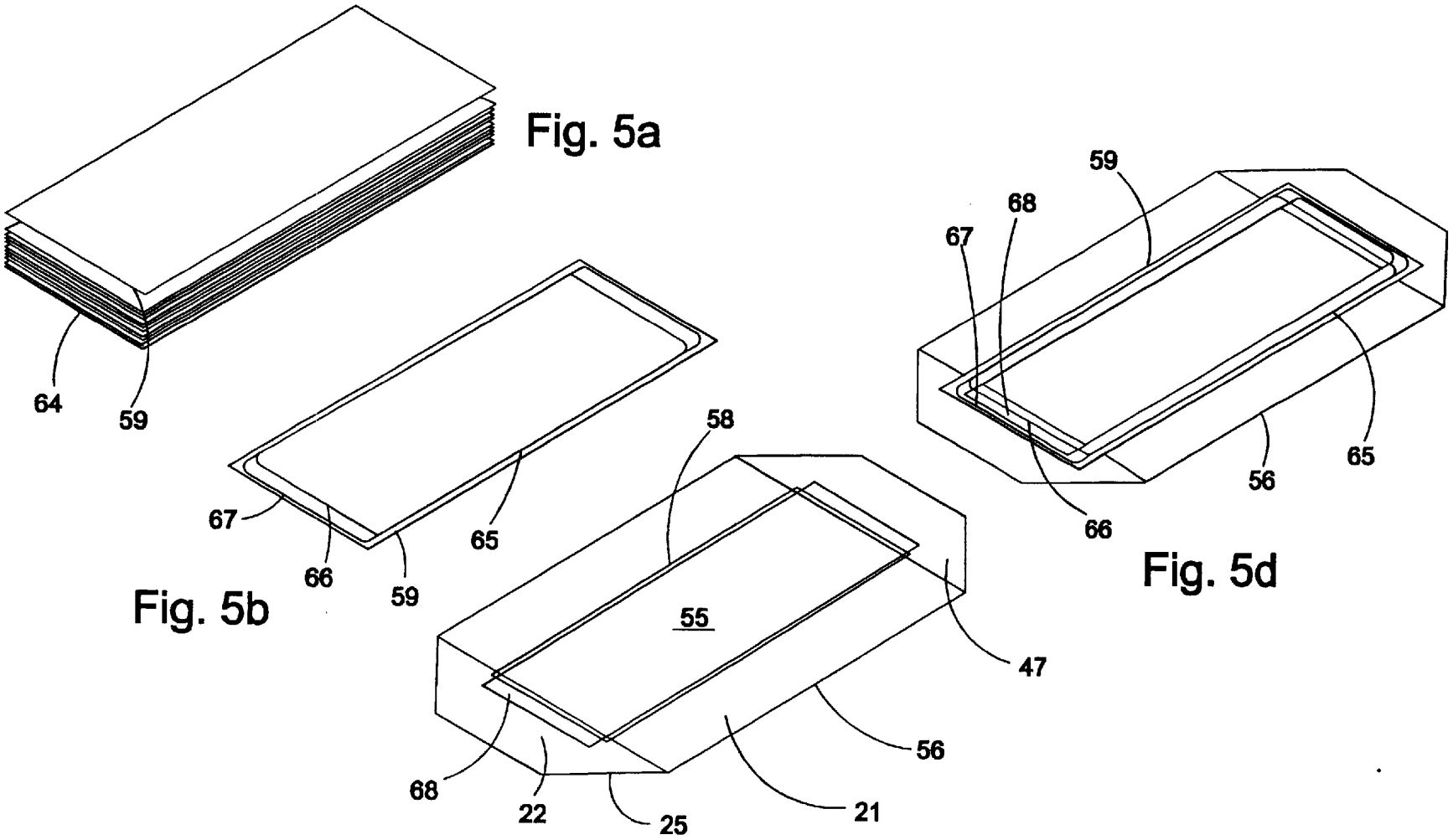

FIG. 5 Shows a sealing collar in detail and a cover sheet;

a) Collecting a cover sheet from the stack;

b) A single cover sheet with adhesive sealing strips;

c) A sealing collar with sealing strips;

d) The sealing collar with cover sheet laid out.

Figures 6A, 6B:
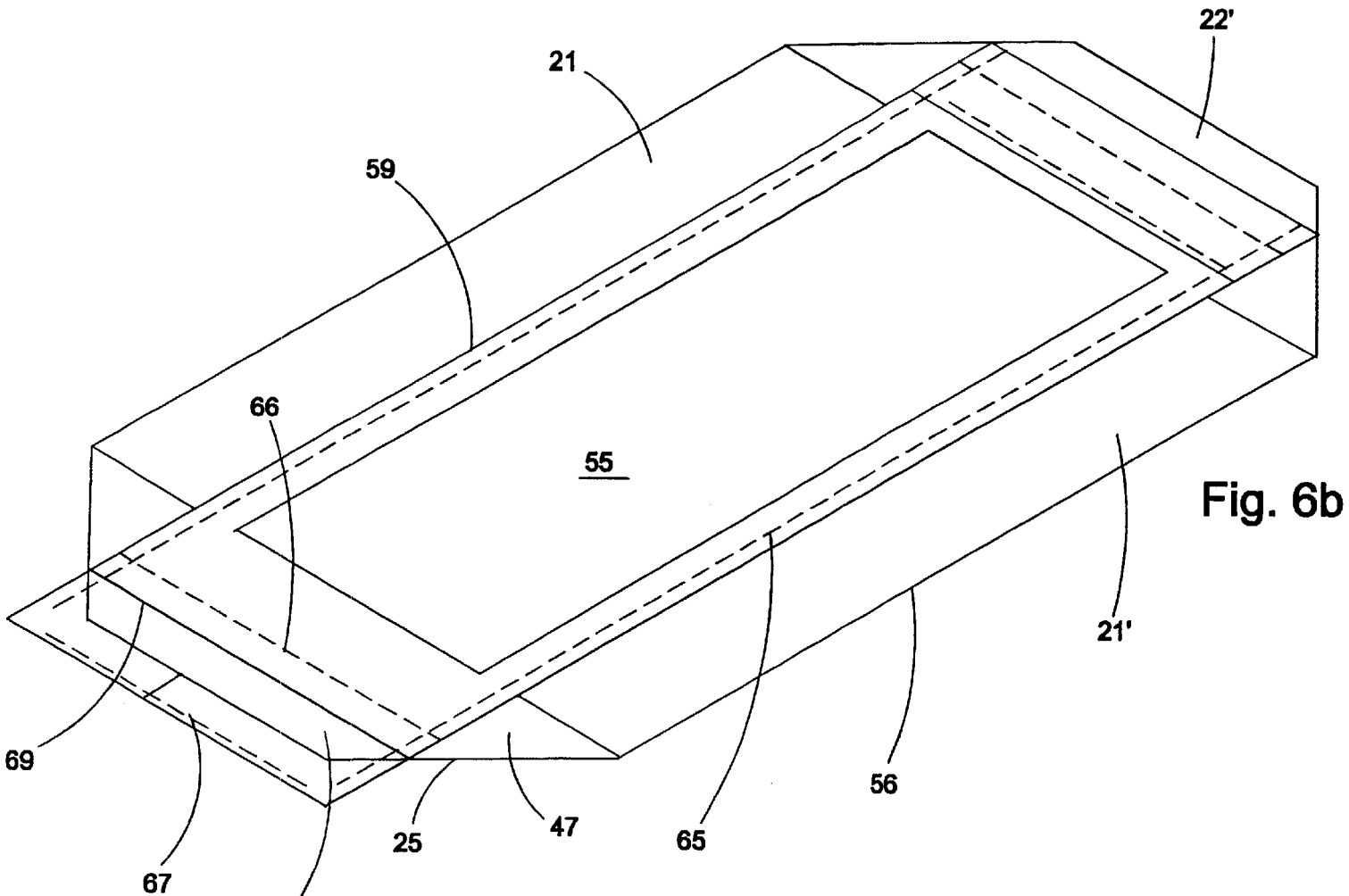

FIG. 6 Shows a sealing collar and a cover sheet laid out a) In an interim phase;

b) After the gluing is complete.

DETAILED DESCRIPTION OF THE PREFERRED EMBODIMENT

In FIG. 1 a rectangular pre-cut sheet 11 is depicted, which has two longitudinal edges 12, 13 and two transverse edges 14, 15. A strip-like adhesive deposit 16 has been applied to the transverse edge 15. Parallel to the transverse edges 12, 13, joint lines 18, 19 are indicated parallel to the edges. The joint line 18 separates the sections of the bag seal from the bag body, and the joint line 19 separates the sections of the bag floor from the bag body. Two-piece first sealing flaps 21*a*, 21*a*' and a further undivided first sealing flap 21*b* are visible on the seal. Between each are two shorter second sealing flaps 22*a*, 22*b*. The respective demarcations of the individual sealing flaps are formed by subsequent folding edges 25 each running at 45° to the side edge 12. Gussets 23 are indicated on the ends of both of the first sealing flaps 21, and there are gussets 24 marked on the ends of both of the second sealing flaps 22.

A section of the sealing area with the first sealing flaps 21*a*, 21*b* and a further, second sealing flap 22*a* lying between it, is indicated in the detail a1), in which are again separated from one another by the folding edge 25. On the other hand, the gussets 23 of the first sealing flaps and the gusset 24 of the second sealing flap 22*a* are marked, and which can come to lie down on top of one another, and are glued or heat-sealed together. In this adaptation the gussets 23 of the first sealing flaps are identified as the exposed surface to be applied with an adhesive deposit.

In diagram a2) the first sealing flaps 21*a*, 21*b*, the second sealing flap 22*a*, as well as the folding edges 25 are marked. Furthermore the gussets 23 of the first sealing flaps and the gusset 24 of the second sealing flap 22*a* are indicated, which come to lie one on top of the other and are then glued or heat-sealed together. In this adaptation the gussets 24 of the first sealing flaps are identified as the exposed surface to be applied with an adhesive deposit.

In the floor section demarcated by the joint line 19 likewise two-piece first sealing flaps 31*a*, 31*a*', a further undivided first sealing flap 31*b* and respective second sealing flaps 32*a*, 32*b* lying between them are visible, and which are separated by subsequent folding edges 35. In this connection the gussets 33 associated with the first sealing flaps 31, and the gussets 34 associated with the second sealing flaps 32 are especially indicated. The floor sections can be folded in a similar manner and glued or heat-sealed as for the sealing sections, in which the process must be completed prior to filling. However the sections of the floor will not be discussed in any further detail.

In b) the pre-cut sheet is shown in perspective view, in which the longitudinal edges 12, 13 and the transverse edges 14, 15 are depicted. In this diagram, apart from the indicated joint lines 18, 19, all subsequent folding edges are likewise indicated, particularly the parallel folding edges 44, 45, already in the area of the body, as well as folding edges 38, 39 running parallel to the transverse edges, which separate a two-piece first side wall 41*a*, 41*a*', an undivided first side wall 41*b* and second side walls 42*a*, 42*b* separated from one another by a central fold line 43.

In c) the method of turning over one on top of the other of both side wall sections 41*a*, 41*a*' is depicted. In practice this folding process as well as other additional folding processes, is a progressive process along the folding edges, which is effected by a displacement movement of a tool opposing the folding edge.

In d) the result of the method indicated in c) is depicted, namely a bag body open at both ends with second wall sections folded outwards, which are not particularly differentiated on the bag body in this case. The sealing strips 46 are identified as a detail.

In e), preparation of the floor and of the seal is carried out by respectively folding along the inner folding edges 44, 45, as well as along the folding edges 25, 35, in which the folds are continued up to the intersection of the respective adjoining folding edges 25, 35.

In f) the first sealing flaps 21 and the adjacent body area are folded outwards up to the folding edges 44 at right angles from the body. In doing this the second sealing flaps 22 are just folded inwards in a line onto the bag opening, in which complementing triangular sections adjoin on a plane up to the folding edge 43. By means of sections of this surface, in which the first sealing flaps 21 lie outwards and the second sealing flap 22 lies inwards, the sealing collar lying on a plane is. subsequently formed, which is depicted by parallel lines.

In g) the first sealing flaps 21 are furthermore formed in their entirety by folding along the joint line 18. Two sealing corners 47 formed by gussets are identifiable in their position and size. These sealing corners are double layered and glued together on their inner surfaces and/or they are heat-sealed together as in the configuration and size depicted here.

In h) the first sealing flaps 21 are folded inwards on top of one another for further transportation of the bag. The pre-formed bag seal 48 and the identical however already sealed bag floor 49 lie in this case at rightangles opposing the compressed bag body 50. They can be unfolded for further transportation on the plane with the bag body along the inner folding edges 44, 45. The finished bag is identified as 51.

In FIG. 2 a rectangular pre-cut sheet 11' is depicted, which has two longitudinal edges 12, 13 and two transverse edges 14, 15. On the transverse edge 15 a strip of adhesive deposit 16 has been applied. Parallel to the transverse edges 12, 13 joint lines 18, 19 are indicated parallel to the edges. The joint line 18 separates the sections of the bag seal from the bag body, the joint line 19 separates the sections of the bag floor from the bag body. On the seal, two-piece first sealing flaps 21*a*, 21*a*' and a further undivided sealing flap 21*b* are visible. Between each are respectively two shorter second sealing flaps 22*a*, 22*b*. The respective demarcations of the individual sealing flaps are formed by incisions 26. On the ends of the first sealing flaps 21 gussets 23 are marked with an adhesive deposit, which lies along the joint line 18; on the ends of the second sealing flaps 22, gussets 24 are marked and which lie along the incisions 26. Each of the adjacent gussets 23, 24 subsequently comes to lie one on top of the other.

In the details a1) and a2) a section of the sealing area with the respective first sealing flaps 21*a*, 21*b* and a first sealing flap 22*a* situated between them are shown, in which these are separated from one another by incisions 26. In adaptation a1), the gussets 23 at the ends of the first sealing flaps 21*a*, 21*b*, running away from the incisions 26, are identified as the exposed surfaces to be applied with an adhesive deposit; in adaptation a2) the gusset 24 at the ends of the second sealing flaps 22*a*, running along the incisions 26, are identified as the exposed surfaces to be applied with an adhesive deposit. In the floor section demarcated by the joint lines 19 likewise two-piece first sealing flaps 31*a*, 31*a*', a further undivided first sealing flap 31*b* and respective second sealing flaps 32*a*, 32*b* situated between them are visible, which are separated by the incisions 36. In this connection the gussets 23 associated with the first sealing flaps 21 and the gusset 24 associated with the second sealing flaps 32 are especially highlighted. The floor sections can be folded in the same manner and glued or heat-sealed as for the sealing sections, in which the process must be totally completed prior to the filling process. However the sections of the floor will not be discussed in any further detail here.

In b) the pre-cut sheet is shown in perspective view, in which the longitudinal edges 12, 13 and the transverse edges 14, 15 are indicated. In this depiction, apart from the joint lines 18, 19 also being given, all subsequent folding edges are indicated in this connection, particularly parallel folding edges 44, 45 lying in the area of the body, as well as folding edges 38, 39 running parallel to the transverse edges, which are separated by a two piece first side wall 41*a*, 41*a*', an undivided first side wall 41*b* and second side walls 42*a*, 42*b* divided by a central fold line 43.

In c) the method of the placing on top of one another of the two side wall sections 41*a*, 41*a*' is depicted. In practice this folding process as well as other additional folding processes, is a progressive process along the folding edges, which is effected by a displacement movement of a tool opposing the folding edge.

In d) the result of the method indicated in c) is depicted, namely a bag body open at both ends with second wall sections folded outwards, which in this case do not particularly differentiate themselves from the bag body. The sealing strip 46 is shown as a detail.

In e), preparation of the floor and of the seal is carried out by folding along the respective inner folding edges 44, 45.

In f) the first sealing flaps 21*a*, 21*b* are visible, which emanate from the ends of the incisions 26, as well as the second sealing flaps 22*a*, 22*b*, which are demarcated by the incisions 26. All four sealing corners 47' are visible, which here have a relatively small surface.

In g) the first sealing flaps 21 formed by folding along the joint line 18 is identified as a detail. Further, two sealing corners 47' are depicted in their position and size. These sealing corners 47' are double layered and glued together on the inner surface of the gussets and/or are to be heat-sealed together, as in the case of this configuration and size.

In h) the first sealing flaps 21 are folded inwards on top of one another for further transportation of the bag. The pre-formed bag seal 48 and the identical however already sealed bag floor 49 lie in this case at rightangles opposing the compressed bag body 50. They can be unfolded for further transportation on the plane with the bag body along the inner folding edges 44, 45. The finished bag is identified as 51.

In FIG. 3 a bag 51 is depicted in the phases of introduction (a), opening and filling (b) and partial sealing (c). The details b1) and c1) refer to the detail drawings in b) and c). The bag indicated in the three phases is in a device, which in this case is not mentioned in detail.

Figures 1A, 1B, 1C, 1D, 1E, 1F, 1G, 1H:
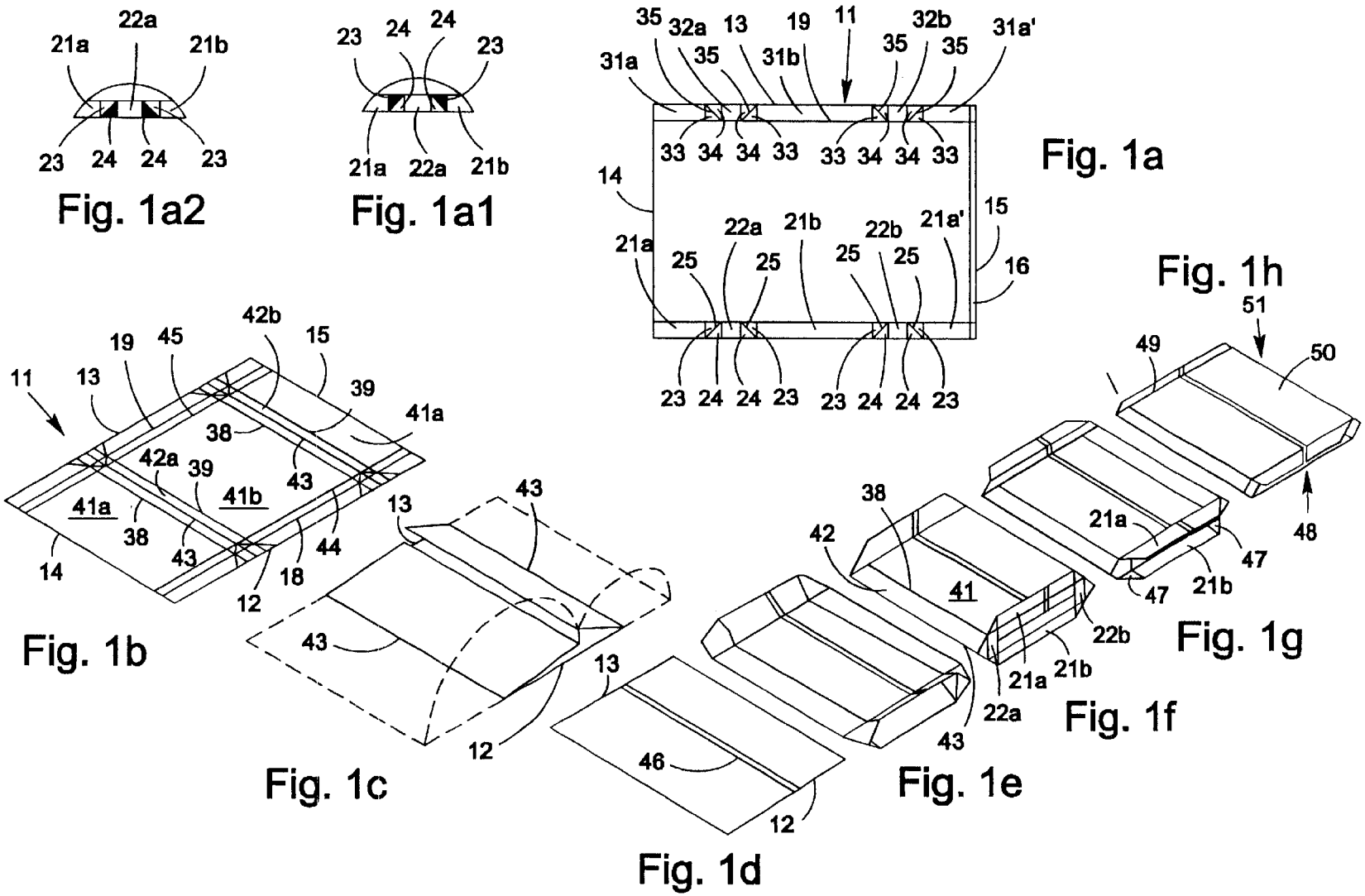
FIG. 1 Shows a first embodiment of a bag according to the invention in various manufacturing phases.

In a) the bag 51 corresponds to the configuration in FIG. 1f), however with vertically suspended bag bodies 50, the second side walls are folded outwards and demarcated by outer folding edges 43. A (sealing flap-) sealing collar 56 formed by the first sealing flaps 21 and the second sealing flaps 22 is in this case complemented by upper wall sections 53 of the first bag walls and end gussets 54 of the second bag walls. Within the rectangular bag opening 55 a slot-like opening 52 is visible on the bag body 50. The first sealing flaps 21 standing at rightangles to the bag body 50 are fed between parallel pairs of conveyor belts, of which here only the lower conveyor belts 111, 112 are depicted. The bag body is fed inside between profiles 113, 114, which support the sealing collar 56 and which open themselves at the end in a y-shape in the direction of movement. The sealing gussets 47 are here already hermetically connected are clearly visible in their position and size.

In FIG. a) the bag can be supported in such a way by additional plant, in particular by widened support profiles 113 and 114 underneath along the extended support profiles 113, 115 of the bag body and up to the conveyor belts, so that it can be held on the bag opening 55 in a firm stable manner with a compressed air function, so that a vacuum test is possible. In this connection a compressed air nozzle can be inserted along a mounting line 57 depicted in b) and sealed along the same. The design of the support profiles can thereby, be air permeable. In this way, any imperfect bags can be rejected prior to filling.

In b) the bag 51 is unfolded, in which the first bag wall 41 is expanded and the second bag wall 42 folded out and completed around the previously mentioned gusset 54, so that the bag walls 41, 42 form the open rectangular bag cross section. The result of the flaring open of the bag shown is preferentially carried out directly by the action of the filling product on the wall sections 53 according to a). The completed formed sealing collar 56, which is demarcated at right angles and diagonally formed at the ends, is depicted here as free standing. Each of the respective outer areas of the first sealing flaps 21*a*, 21*b* are held by further pairs of conveyor belts 115, 116, in which a conveyor belt located above the latter pair is partially depicted. The inner areas of the first sealing flaps 21 are supported by profiles 117, 188 running parallel to each other. With a somewhat central mounting line 57, which is indicated on the sealing collar 56, a surface is indicated onto which a filling nozzle is mounted; further inwards, directly along the edge of the bag opening 55, a sealing line 58 is indicated, which demarcates an inner area to be kept dust free during filling. As clearly demonstrated in this case, the first sealing flaps 21 are turned up outwards at right angles beyond the bag opening 55, whilst the second sealing flaps 22 are folded inwards onto the bag cross section.

In c) the bag is essentially the same configuration as in b), in which additional conveyor belts 119, 120 are again only partially depicted. Furthermore the support profiles 121, 122 are visible, on whose front ends an upper pressure roller 123 and counter-pressure rollers 124 located underneath are specified. The pressure roller 123 are only shown as partial details, and actually extends along the whole width of the support profiles. A cover sheet 59 is rolled out over the bag opening, which is held in the same previously indicated dust free area and glued to one of the glued edges 60 on the underside. The laying out of the cover sheet 59 can be carried out by the pressure roller 123 when transporting the bag from b) to c).

In FIG. 4 a bag is depicted in different phases, in which the seal of the bag 51' is specified according to the manner described in FIG. 2. A device similar to that indicated in FIG. 3 is indicated by several pairs of conveyor belts, of which only the lower conveyor belts are shown. In a) the seal 48' is shown in top view at the beginning of the transportation route, according to e). In b) the bag is indicated in position after the filling process, according to i), in which the slot-like opening 52 takes up its flared open position, the first sealing flaps 21*a*, 21*b* standing outwards at right angles from the bag opening and the second sealing flaps 22*a*, 22*b* are folded inwards onto the bag cross section.

In c) a bag is shown per FIG. 2 h) in a transportable position, after the bag seal 48' and the bag floor 49' have been folded on to the body 50.

A stack of bags 51" is shown in d), in which it is clearly visible how the seals 48 and the floors 49 are each folded out on to the bag body. The bags differentiate themselves from those previously described however in that the second side walls are turned inwards along the demarcation lines 38, 39 of the first side walls 41 and folded onto themselves, so that the second side walls are not visible. The gussets 54*a*, 54*b* still visible in c) are however not visible, as they are folded inwards between the walls 41.

In e) one can see how a bag is introduced onto the conveyor belt, in which the seal 48 and floor 49 again stands away at right angles from the body 50.

In f) a partial opening is performed during transportation by a device not non depicted, in which the first sealing flaps 21*a*, 21*b* are raised up in the position shown in FIG. 2 g).

In g) the seal is opened wider during previously mentioned further transportation displacement, so that the first sealing flaps now stand off at right angles from the bag body per the drawing in FIG. 2 f).

In h) the completely opened out bag is depicted after filling, which also shows the relief bag opening 55. The second side walls with their centre fold 43 and end gusset 54 are visible.

In i) the bag is transported further to a position, in which highlights how a cover sheet 59 is attached, whilst in the previous position the filling takes place. In this connection reference is made to the details i1), i2) and i1') and i2') and i3').

In i1), it is demonstrated how the second sealing flaps 22 are folded backwards at the centre over themselves, whereas in i2) the rolling out of sealing flaps 59 onto the opening 55 is symbolised. In this connection the sealing strips 62 are supported by wedges inserted underneath during gluing and heat-sealing the cover sheet 59 to the rear side.

In i1'), it is depicted how the second sealing flaps 22 can be designed with vertically standing sealing strips 62, and in which a cover sheet 59' can in the same sense have vertically angled folded out sealing edges 63, whereas in i3') the addition of flat cover sheet 59' between the second sealing flaps 22 is carried out. Along the double band of sealing-strips and -edges, pairs of rollers can roll along, or pairs of strips can attach themselves, so that the gluing or heat-sealing is supported.

In j) beginning of the folding together of the first sealing flaps 21*a*, 21*b* after the cover sheet 59 has been attached, is indicated. In k) finally the completely sealed bag with the second sealing flaps 21*a*, 21*b* laid out on top of one another is indicated, which can be glued to one another.

In k1) the seal completed in this manner is once again indicated as a detail. In comparison, k2) shows a symmetric laying out on top of one another of the first sealing flaps; also the bag is finally sealed in this manner, which again can be performed by gluing or heat-sealing the two sealing flaps.

FIG. 5 shows a) a stack 64 of cover sheets, which depicts a first cover sheet 59 being lifted off, which is diagonally displaced and onto which an adhesive deposit applied.

In b) the cover sheet 49 is indicated with an adhesive strip applied on the underside, the first adhesive track 65 along the length of the longitudinal edges and double band adhesive track 66, 67 along the length of the transverse edges. These adhesive tracks can be applied using jets; it is also possible for the whole edge of the sheet to have glue applied beyond the tracks 65, 66.

In c) a sealing collar 56 with first sealing flaps 21 and second sealing flaps 22 are indicated, which arises by folding along the folding edges 25. The double layered sealing corners 47 lie within the folding edges 25. The bag opening 55 is enclosed by the sealing collar 56, at a minimal distance from this the sealing line 58 is indicated. The double folded sealing strips 68 are placed onto the second sealing flaps 22 on the flat pre-cut sheet during bag manufacture, and whose folding edge runs inwards along the bag opening and opens outwards in a V-shape. The lower strips of these sealing strips 68 are glued or heat-sealed to the respective second sealing flaps 22, the upper strips can be folded out adjoining to the folding edge. It is visible that the essential area of these sealing strips 68 lies beyond the sealing line 58, and in so doing are kept free of dust during filling.

In d) one can see how the cover sheet 59 is placed on the bag opening 55. The first adhesive tracks 65 are essentially connected to the first sealing flaps 21, the second adhesive tracks 66, 67 are firstly connected to the sealing strips 68, which initially can be supported from underneath on the reverse side, and secondly directly connected beyond the same to the second sealing flaps 22, so that absolutely no ports of entry into the bag via open slots or slits arise.

In FIG. 6) a sealing collar 56 is indicated, consisting of the first sealing flaps 21 and the second sealing flap 22, with the double layered sealing corners 47, in which the bag opening 55 is already sealed by a cover sheet 59 laid on it. On the second sealing flaps 22 shown at the front in a), the cover sheet 59 lies formed on a plane; on the sealing flap 22 shown behind in b) the cover sheet is folded back onto itself at the end. On the cover sheet running lengthways, first adhesive tracks 56 can be seen, which are glued to the first sealing flaps 21 and run into the area of the sealing corners 47. Furthermore the crossways running inner adhesive tracks 66 and outer adhesive track 67 are visible, as well as a folding edge 69. As shown in b), the cover sheet is folded onto itself along the folding edge 69, so that a multiple seal of the bag opening is ensured by the cover sheet 59 glued on, which can also endure impacts, if the first sealing flap 21 is folded inwards onto the cover sheet 59 and comes into contact with it.

Reference No. List

11 Pre-cut sheet
12 Longitudinal edge
13 Longitudinal edge
14 Transverse edge
15 Transverse edge
16 Adhesive deposit
18 Joint line
19 Joint line
21 First sealing flab
22 Second sealing flap
23 Gusset
24 Gusset
25 Folding edge
26 Incision
31 First sealing flap
32 Second sealing flap
34 End gusset
35 Folding edge
36 Incision
38 Folding edge
39 Folding edge
41 First side wall
42 Second side wall
43 Folding edge
44 Inner folding edge
45 Inner folding edge
46 Sealing strip
47 Sealing corners
48 Bag seal
49 Bag floor
50 Bag body
51 Bag (finished)
52 Opening (slit)
53 Bag wall
54 End gusset
55 Bag opening
56 Sealing collar
57 Mounting line
58 Sealing line
59 Cover sheet
60 Adhesive edge
62 Sealing strip
63 Sealing strip
64 Stack of sheets
65 Adhesive track
66 Adhesive track
67 Adhesive track
68 Sealing strip
69 Folding edge
111 Conveyor belt
112 Conveyor belt
113 Conveyor angle
114 Conveyor angle
115 Conveyor belt
116 Conveyor belt
117 Support angle
118 Support angle
119 Conveyor belt
120 Conveyor belt
121 Support angle
122 Support angle
123 Pressure roller
124 Counter-pressure roller

What is claimed is:

1. A semi-finished bag in a compressed flat configuration set for transporting prior to the opening and filling processes, which comprises a bag body with four bag side walls formed on a pre-cut sheet, said sheet having longitudinal crease folds for each of said four bag side walls, onto which two first wide bag side walls lie congruently on top of one another, and two second narrower bag side walls folded over respectively onto themselves at the center in a line along their longitudinal edges, said bag body having top and bottom ends, gusset pairs formed in said narrower bag side walls adjacent to said top and bottom ends, said bag sealed at said bottom end of the bag body by a bag floor, said floor including a portion of said longitudinal crease folds, said bag having a bag opening at the top end of the bag body, an unsealed bag seal adjoining the bag opening on the bag body, the bag seal comprising two first sealing flaps adjoining the first wide bag side walls lying on top of one another, and two second sealing flaps extending from the gusset pairs in the second narrower bag side walls folded over onto themselves at the center in a line of the fold of the second bag walls, said second sealing flaps and said gusset pairs folded inwardly onto the bag opening prior to closing said bag by folding over said first sealing flaps, each of said gusset pairs bonded together to form double layered sealing corners prior to filling and sealing the bag to minimize dust on the sealing surfaces from the filling procedure.

2. A bag according to claim 1, wherein a demarcation edge of the gussets is formed by a joint line of the respective first sealing flaps and that a congruent demarcation edge of the gussets runs at right angles to a relief longitudinal edge of the respective second sealing flaps in which congruent demarcation edges run parallel to the bag opening after the folding process of the bag seal.

3. A bag according to claim 1, wherein the sealing flaps including their gussets are each demarcated by a common folding edge emanating from joint lines of the sealing flaps on the bag body at an angle of 45° to these joint lines.

4. A bag according to claim 1, wherein the sealing flaps including their gussets are each demarcated by sealing flaps emanating from joint lines of the sealing flaps on the bag body.

5. A bag according to claim 1, wherein the second bag walls and the second sealing flaps are folded inwards between perimeter areas of the first bag walls.

6. A bag according to claim 1, wherein the second bag walls and the second sealing flaps are folded outwardly lying beyond perimeter areas of the first bag walls.

7. A bag according to claim 1, wherein the first sealing flaps are folded together on the plane with the first bag walls laid on top of one another.

8. A bag in a configuration set for filling comprising a bag floor, a bag top, a bag body with four bag side walls emanating from the bag floor of essentially rectangular cross section, two of said four bag walls forming opposing wide first bag side walls and two of said four bag walls forming opposing narrow second bag side walls, each of said narrow second bag side walls having a centrally positioned folding edge running longitudinally with said narrow bag walls, gusset pairs formed in the narrow second bag side walls at top and bottom ends thereof, an unsealed bag seal adjoining the bag body with a joint line between said bag body and bag seal defining a bag opening at the top end, two first sealing flaps adjoining the opposing two wide first bag side walls standing outwardly at right angles away from the bag body on a plane with the bag opening, and two second sealing flaps adjoining the opposing two narrow second bag side walls at the gusset pairs, said second sealing flaps and said gusset pairs turned inwardly at right angles onto the bag body on a plane with the bag opening, each of said turned in gusset pairs extending to the first sealing flaps and bonded together to form double layered sealing corners and a sealing collar prior to closing said bag by folding said first sealing flaps.

9. A bag according to claim 8, wherein the first sealing flaps and the second sealing flaps interlock one another and are demarcated by a common folding edge.

10. A bag according to claim 8, wherein the first sealing flaps and the second sealing flaps have transverse edges formed by respective incisions in the initial material.

11. A bag in filled and partially sealed configuration which comprises a bag floor, a bag top, a bag body with four bag side walls emanating from the bag floor of essentially rectangular cross section, two of said four bag side walls forming opposing wide first bag side walls and two of said four bag walls forming opposing narrow second bag side walls, each of said narrow second bag side walls with a centrally positioned fold line running longitudinally with said narrow second bag side walls, gusset pairs formed in the opposing narrow second bag side walls at top and bottom ends thereof, an unsealed bag seal adjoining the bag body with a joint line between the bag body and bag seal defining a bag opening, two first sealing flaps of the bag seal adjoining the opposing wide first bag side walls standing outwardly at right angles away from the bag body in a plane with the bag opening, two second sealing flaps of the bag seal adjoining the opposing narrow second bag side walls at the gusset pairs, said second sealing flaps and said gusset pairs folded over inwardly at right angles onto the bag body in a plane with the bag opening, each of said gusset pairs running to the first sealing flaps and bonded together prior to folding the first sealing flaps inwardly in a plane with the bag opening to form double layered sealing corners so the sealing flaps connected by the sealing corners together form a sealing collar, and a cover sheet laid out on the sealing collar connected circumferentially to the first and second sealing flaps.

12. A bag according to claim 11, wherein sealing strips are designed on relief longitudinal edges of the second sealing flaps folded over away from the bag opening plane, and a cover sheet is laid out on the bag opening lying with its side edges on the first sealing flaps and connected to these, and includes sealing edges on the ends standing off from the sheet plane and connected to said sealing strips of the second sealing flaps.

13. A bag for filling with a product, which comprises a rectangular cross sectioned, flared open bag body comprising a top and a bottom, two wider first bag side walls and two narrower second bag side walls, a bag floor sealed onto the bottom of the bag body; a bag opening demarcated at the top of the bag body, gusset pairs formed in the narrower second bag side walls near the top of the bag body, first sealing flaps standing off outwardly at right angles to the first bag walls of the bag opening, and second sealing flaps respectively adjoining said gusset pairs in said second bag walls, each of said gusset pairs folded inwardly onto the bag opening and bonded together to form double layered sealing corners prior to closing said bag by folding over said first sealing flaps, said first and second sealing flaps forming a frame shaped sealing collar.

* * * * *